US006552706B1

(12) United States Patent
Ikeda et al.

(10) Patent No.: US 6,552,706 B1
(45) Date of Patent: Apr. 22, 2003

(54) ACTIVE MATRIX TYPE LIQUID CRYSTAL DISPLAY APPARATUS

(75) Inventors: Naoyasu Ikeda, Tokyo (JP); Hidenori Ikeno, Tokyo (JP); Hiroshi Tsuchi, Tokyo (JP); Takashi Nose, Tokyo (JP)

(73) Assignee: NEC Corporation, Tokyo (JP)

( * ) Notice: Subject to any disclaimer, the term of this patent is extended or adjusted under 35 U.S.C. 154(b) by 287 days.

(21) Appl. No.: 09/619,307

(22) Filed: Jul. 19, 2000

(30) Foreign Application Priority Data

Jul. 21, 1999 (JP) ..... 11-205507

(51) Int. Cl.[7] ..... G09G 3/36
(52) U.S. Cl. ..... 345/96; 345/92; 345/100
(58) Field of Search ..... 345/96, 92, 93, 345/99, 100, 88, 213; 349/106, 143, 144

(56) References Cited

U.S. PATENT DOCUMENTS

| | | | | |
|---|---|---|---|---|
| 4,781,438 A | * | 11/1988 | Noguchi | 345/88 |
| 4,834,505 A | * | 5/1989 | Migliorato et al. | 349/106 |
| 5,457,552 A | * | 10/1995 | Ogurtsov et al. | 345/93 |
| 5,485,293 A | * | 1/1996 | Robinder | 345/88 |
| 6,072,457 A | * | 6/2000 | Hashimoto et al. | 345/100 |
| 6,259,504 B1 | * | 7/2001 | Shin et al. | 349/106 |
| 6,327,008 B1 | * | 12/2001 | Fujiyoshi | 345/96 |
| 6,342,876 B1 | * | 1/2002 | Kim | 345/213 |

FOREIGN PATENT DOCUMENTS

| | | |
|---|---|---|
| JP | 3-78390 | 4/1991 |
| JP | 10-197894 | 7/1998 |
| JP | 10-282937 | 10/1998 |

OTHER PUBLICATIONS

Korean Patent Office Official Action issued on Apr. 30, 2002.

* cited by examiner

*Primary Examiner*—Steven Saras
*Assistant Examiner*—Uchendu O. Anyaso
(74) *Attorney, Agent, or Firm*—Whitham, Curtis & Christofferson, P.C.

(57) ABSTRACT

An active matrix type liquid crystal display apparatus can reduce occurrence of flicker, which can be a cause of degradation of picture quality even in a particular fixed pattern, by using a data driver circuit constantly inverting polarity of voltage of adjacent outputs. The active matrix type liquid crystal display apparatus has display picture elements, each consisting of four pixels of first to four pixels arranged vertically and horizontally per two, scanning lines, each being in common for the four pixels, data lines arranged per two on opposite sides of vertically aligned two pixels, a common electrode being common for the four pixels, and a data driver circuit for writing voltages from the datalines simultaneously for the four pixels of each picture element when the one scanning line is selected. The pixels are located at the same position in laterally adjacent picture elements being connected to data lines at different sides relative to each other. The data driver circuit is controlled to apply different polarities of voltages to adjacent data lines with respect to a voltage for the common electrode, and to invert polarities of the voltages to be applied to respective data lines with respect to the voltage of the common electrode when the scanning line is selected.

9 Claims, 16 Drawing Sheets

FIG.12
(PRIOR ART)

| | | | | | | | |
|---|---|---|---|---|---|---|---|
| G | R | G | B | G | R | G | B |
| G | B | G | R | G | B | G | R |
| G | R | G | B | G | R | G | B |
| G | B | G | R | G | B | G | R |
| G | R | G | B | G | R | G | B |
| G | B | G | R | G | B | G | R |
| G | R | G | B | G | R | G | B |
| G | B | G | R | G | B | G | R |

ACTIVE MATRIX TYPE LIQUID CRYSTAL DISPLAY APPARATUS

BACKGROUND OF THE INVENTION

1. Field of the Invention

The present invention relates generally to an active matrix type liquid crystal display apparatus. More particularly, the invention relates a flicker lowering system in an active matrix type liquid crystal display apparatus.

2. Description of the Related Art

A drive method of a color display, in which one picture element consists of four pixels, is disclosed in Japanese Unexamined Patent Publication No. Heisei 3-78390, for example. An active matrix type liquid crystal display apparatus and a pixel structure is disclosed in Japanese Unexamined Patent Publication No. Heisei 3-78390 are illustrated in FIGS. 11 and 12.

In FIG. 11, L denote liquid crystal cells arranged in a matrix, C denote storage capacitors arranged in parallel to the liquid crystal cells, T denote field effect transistors (FET or TFT), each drain electrode of which is connected to one of electrodes of each liquid crystal cell L. Each pixel consists of these three elements.

X denote a plurality of X electrodes (data lines) commonly connected to input electrodes (source electrodes) of transistors per each column, in the matrix, Y denote a plurality of Y electrodes (gate line or scanning line) connected to gate electrodes of the transistors T in common per each row in the matrix, and Z denotes a common electrode commonly connected to other electrodes of all liquid crystal cells L. On the other hand, the reference numeral 100 denotes a scanning circuit sequentially applying scanning pulses to scanning lines Y, 200 denotes a driver circuit sampling/holding a video signal and converting the video signal equal to one horizontal line into parallel video signals of the number corresponding to number of data lines for supplying respective parallel video signals to respective data lines.

Referring to FIG. 12, a minimum picture element consists of four pixels of red (R), green (G), green (G) and blue (B) arranged in square matrix. Polarities of voltages to be applied to respective pixels are controlled so that a polarity of the voltage to be applied to one pixel region consists of a pair of red pixel and green pixel and a polarity of the voltage to be applied to the other pixel region consists of a pair of blue pixel and green pixel are opposite with respect to each other. In the alternative, a polarity of the voltage to be applied to one pixel region consists of a pair of green pixels and a polarity of the voltage to be applied to the other pixel region consists of a pair of red pixel and blue pixel are opposite with respect to each other.

FIG. 13 shows polarities of voltages to be applied to respective pixels in the case where the polarity of the voltage to be applied to one pixel region consists of a pair of red pixel and green pixel and a polarity of the voltage to be applied to the other pixel region consists of a pair of blue pixel and green pixel are opposite with respect to each other. On the other hand, FIG. 14 shows polarities of voltages to be applied to respective pixels in the case where the polarity of the voltage to be applied to one pixel region consists of a pair of green pixels and the polarity of the voltage to be applied to the other pixel region consists of a pair of red pixel and blue pixel are opposite with respect to each other. It should be noted that in FIGS. 13 and 14, the hatched portions represent the regions applied one polarity (e.g. positive or negative) of voltage and the blank portions (not hatched) represent the regions applied the other polarity (e.g. negative or positive) of voltage.

In the construction set forth above, when one color display of red is performed for an area perceptible by a human eye, for example, polarities of voltages to be applied per each field become the same with each other in all red pixels to inherently cause flicker irrespective of a pitch of the pixels. In the above-identified publication, discussion has been given for flicker lowering effect for yellow (green and red), cyan (green and blue), green (green and green) and magenta (red and blue). However, no discussion has been given for flicker lowering effect for red simple color.

In the above-identified publication, as an alternative embodiment, another pixel structure is illustrated in FIGS. 15 and 16. However, in either case, occurrence of flicker is inevitable in the case of red simple display. When the display is used as an output device of a computer, red simple display is frequently used. Therefore, it is highly possible to cause flicker.

A problem in the prior art set forth above, in such liquid crystal display apparatus, occurrence of flicker can be increased when particular simple color pattern is displayed, such as red simple color, for example. The reason is that a polarity of the voltage to be applied to the pixel is the same in respective pixels of red, green and blue to achieve cancellation effect when color matching with the polarity pattern is displayed.

SUMMARY OF THE INVENTION

It is therefore an object of the present invention to provide an active matrix type liquid crystal display apparatus which can reduce occurrence of flicker, which can be a cause of degradation of picture quality even in particular fixed pattern, by using a data driver circuit constantly inverting polarity of voltage of adjacent outputs.

According to the first aspect of the present invention, an active matrix type liquid crystal display apparatus comprises:

- display picture elements, each consists of four pixels of first to four pixels arranged vertically and horizontally per two;
- scanning lines, each being in common for the four pixels;
- data lines arranged per two on opposite sides of vertically aligned two pixels;
- a common electrode being common for the four pixels;
- a data driver circuit for writing voltages from the data lines simultaneously for the four pixels of each picture element when the one scanning line is selected,
- the pixels located at the same position in laterally adjacent picture elements being connected to data lines at different sides relative to each other; and
- the data driver circuit being controlled to apply different polarities of voltages to adjacent data lines with respect to a voltage for the common electrode, and to invert polarities of the voltages to be applied to respective data lines with respect to the voltage of the common electrode when the scanning line is selected.

In the preferred construction, the data driver circuit performs control for inverting polarity with respect to the common electrode per frame.

According to the second aspect of the present invention, an active matrix type liquid crystal display apparatus comprises:

a plurality of mutually parallel data lines;

a plurality of mutually parallel scanning lines arranged perpendicular to the data lines;

field effect type transistors, each provided in the vicinity of each intersection of the data line and the scanning line;

pixel electrodes, each connected to the field effect type transistor;

a common electrode;

liquid crystal provided between the pixel electrodes and the common electrode, each four pixels forming one picture element;

a scanning circuit sequentially applying voltages to the scanning lines;

a data driver circuit receiving a display data and applying voltages corresponding to the display data for the data lines;

the display driver circuit controlling application of voltage so that polarities of the voltages to be applied to first, second, third and fourth pixels of a first picture element at an arbitrary position of a display portion relative to a voltage of the common electrode are the same polarity in the first and second pixels, the same polarity in the third and fourth pixels and opposite polarity in the first and third pixels;

so that polarities of voltages to be applied to the first to fourth pixels of the first picture element relative to the voltage of the common electrode are inverted at a period of a frame frequency;

so that polarities of voltages to be applied to fifth, sixth, seventh and eighth pixels located at the corresponding position to the first pixel in second, third, fourth and fifth picture elements adjacent to the first picture element in vertical and lateral directions are opposite to the polarity of the voltage to be applied to the first pixel;

so that the polarities of voltages to be applied to ninth, tenth, eleventh and twelfth pixels located at the corresponding position to the first pixel in sixth, seventh, eighth and ninth picture elements obliquely adjacent to the first picture element respectively located at obliquely upper left side, obliquely upper right side, obliquely lower left side and obliquely lower right side are the same as the polarity of the voltage to be applied to the first pixel.

In the preferred construction, the first, second, third and fourth pixels may display red, green, green and blue. In the alternative, the first, second, third and fourth pixels may display red, green, white and blue. In the further alternative, the first, second, third and fourth pixels may display white, respectively.

Discussing the operation of the present invention, each picture element in the display portion consists of four pixels. These four pixels are arranged to form a 2×2 matrix. On opposite sides of each vertically aligned set of pixels, two data lines are arranged. Thus, a total of four data lines are arranged in each picture element. When one gate bus line is selected, voltages are written simultaneously for four pixels. The pixels laterally adjacent with each other are connected to data lines on opposite sides. Mutually opposite polarities of the voltages with respect to the voltage of the counter electrode (common electrode) are applied to adjacent data lines. The polarity of the voltage to be applied to each data bus line is inverted every time of sequential selection of the gate bus line.

As set forth above, one picture element consists of four pixels, and the combination of data bus lines to be connected to the pixels at the same positions in laterally adjacent picture elements are alternated for applying voltages to respective pixels in such a manner that the polarities of the voltages to be held during a certain frame period with respect to the voltage of the counter electrode in the pixels located at the same position as the pixel in one picture element, in the picture elements adjacent in vertical and lateral directions, are opposite to that held in the pixel of the one picture element. At the same time, within one picture element, the polarity of two pixels is positive and the polarity of the other two pixels is negative.

At this time, each pixel is adapted to perform color display. Assuming that the arrangement of colors in each picture element is the same, to the pixels of the same color in adjacent picture elements are applied mutually opposite polarities of voltages. Thus, variation of luminance can be canceled to avoid increasing of flicker even in display of fixed display pattern of simple color. Also, since one picture element consists of four pixels, and mutually opposite polarities of voltages are applied for respective pairs of two pixels, increasing of flicker can be avoided even in one picture element.

BRIEF DESCRIPTION OF THE DRAWINGS

The present invention will be understood more fully from the detailed description given hereinafter with reference to the accompanying drawings of the preferred embodiment of the present invention, which, however, should not be taken to be limitative to the present invention, but are for explanation and understanding only.

In the drawings:

FIG. 12 is a schematic illustration showing a pixel structure of the conventional liquid crystal display apparatus;

DESCRIPTION OF THE PREFERRED EMBODIMENT

Figure 1:
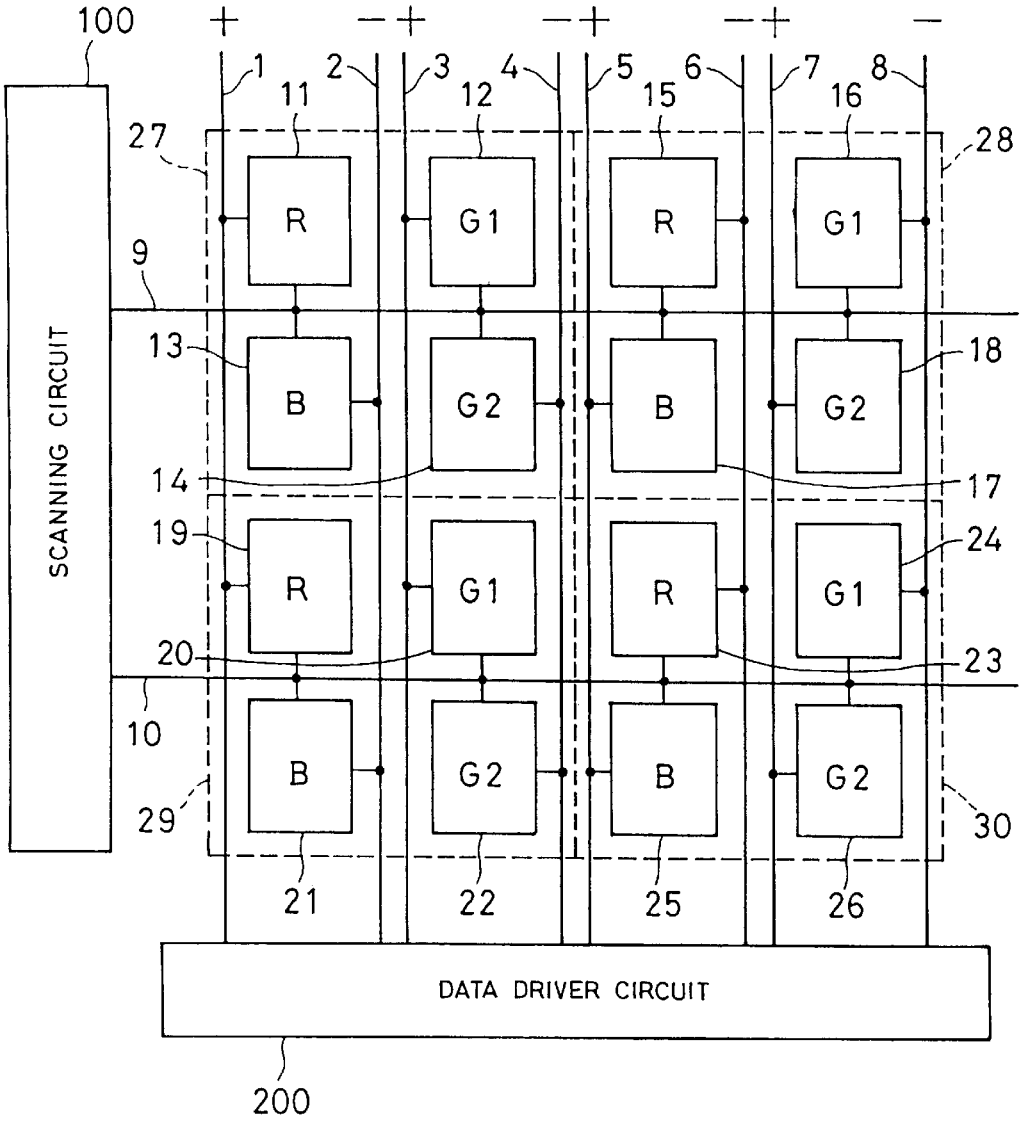
FIG. 1 is a schematic block diagram showing a pixel structure of the first embodiment of an active matrix type liquid crystal display apparatus according to the present invention.

The present invention will be discussed hereinafter in detail in terms of the preferred embodiment of the present invention with reference to the accompanying drawings. In the following description, numerous specific details are set forth in order to provide a through understanding of the present invention. It will be obvious, however, to those skilled in the art that the present invention may be practiced without these specific details. In other instance, well-known structure are not shown in detail in order to avoid unnecessary obscurity of the present invention. It should be noted that like reference numerals to those shown in FIGS. 11 to 16 will represent like components. Detailed description of such common components will be omitted in order to avoid redundant disclosure and whereby to keep the application simple enough for facilitating clear understanding of the invention.

FIG. 1 is an illustration showing an arrangement of pixels in a partial region of a display portion in the first embodiment of an active matrix type liquid crystal display apparatus according to the present invention. It should be noted that a circuit structure of the first embodiment of the active matrix type liquid crystal display apparatus is the same as that illustrated in FIG. 11. A signal to be applied to the data driver circuit 200 driving data bus lines as data lines (X of FIG. 11) is differentiated. On the other hand, the scanning circuit 100 is the same as that of FIG. 11.

In FIG. 1, the reference numerals 1 to 8 denote data bus lines, 9 and 10 denote gate bus lines, and 11 to 26 are pixels. One picture element is formed with a portion surrounded by broken lines 27 to 30 and consists of four pixels. Signs R, B, G1 and G2 labeled within respective blocks of the pixels 11 to 26 represent red display, blue display, first green display and second green display of respective pixels. In FIG. 1, positive sign (+) and negative sign (−) shown on data bus lines represent polarity of voltage to be applied to data bus lines 1 to 8 when the gate bus line 9 is selected at certain frame with respect to a voltage of a counter electrode (common electrode).

Each pixel is connected to one data bus line and one gate bus line. For example, the pixel 11 is connected to the data bus line 1 and the gate bus line 9. When the gate bus line 9 is selected, voltages applied to the data bus lines 1 to 8 are written in the pixels 11 to 18.

It should be noted that, in the foregoing disclosure, discussion has been given for the case where sixteen pixels of a part of the liquid crystal display apparatus are extracted. However, the number of the pixels are not restricted to the number of pixels shown. Similarly, the number of data and gate bus lines are not restricted to the shown numbers. Also, display color of the pixels in each picture element is not specified to have one red and one blue pixel and two green pixels, but can be of any other combination of the colors of the pixels for forming the picture element.

Figure 2:
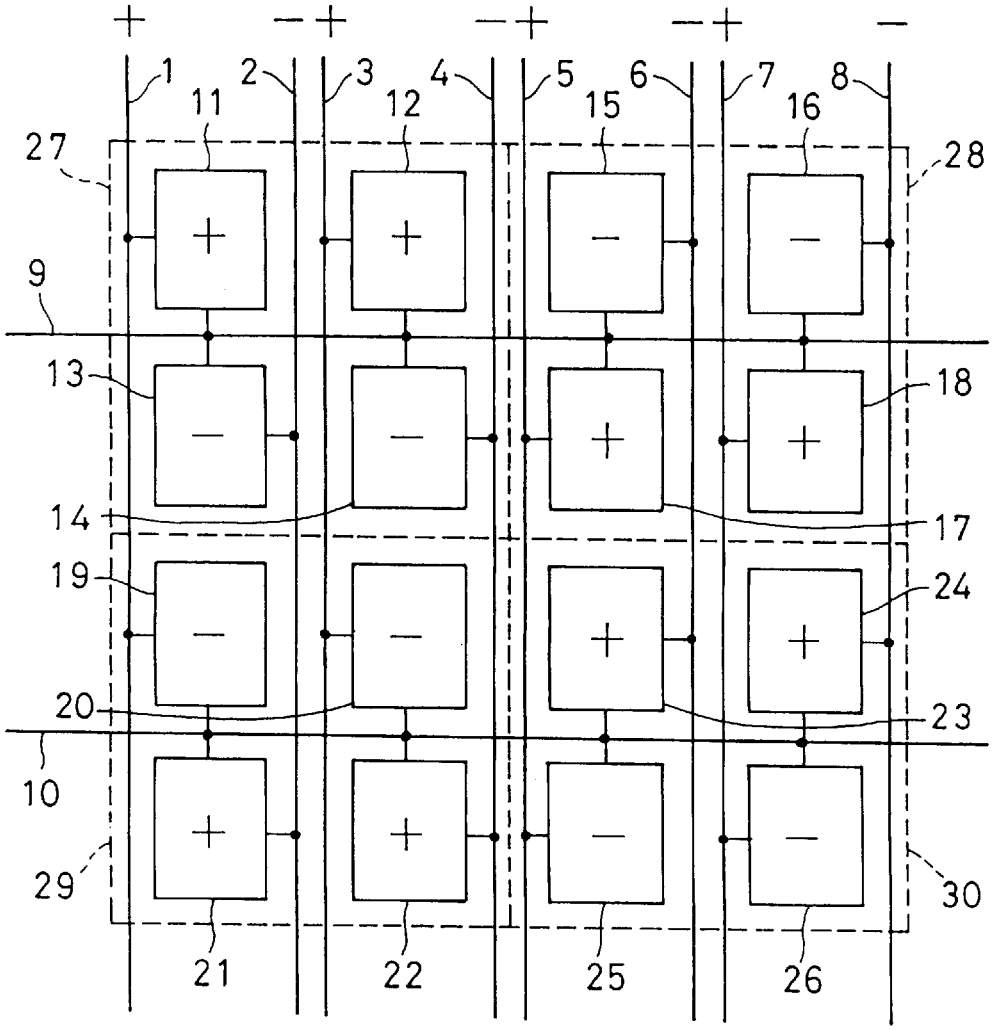
FIG. 2 is a schematic illustration showing polarities of voltages applied to respective pixels in the first embodiment of the active matrix type liquid crystal display apparatus according to the present invention.

Next, operation of the first embodiment of the active matrix type liquid crystal display apparatus shown in FIG. 1 will be discussed hereinafter. FIG. 2 is an illustration showing polarities of holding voltages to be applied to the pixels in a certain frame period relative to the voltage of the counter electrode in order to discuss the shown embodiment of the present invention. In FIG. 2, the blocks labeled with "+" are blocks applied the pixel voltage which is positive relative to the voltage of the counter electrode, and the blocks labeled with "−" are blocks applied the pixel voltage which is negative relative to the voltage of the counter electrode.

In FIG. 1, consideration is given for the case where red is displayed over the entire area of the display portion, for example. Polarities of the voltages applied to the pixels 11 and 23 are positive and the polarities applied to the pixels 15 and 19 are negative. Such polarity pattern of the voltages can be extended over the entire area of the display portion. When the polarity of the particular red pixel is positive, polarities of the voltages applied to red pixels next to the particular red pixels in upper side, lower side, left side and right side become negative. Namely, the red pixels applied the voltages of positive polarity are arranged in a checkered pattern. Likewise, the red pixels applied the voltage of negative polarity are arranged in a checkered pattern.

Considering one picture element, polarities of voltages to be applied to the pixels 11 and 12 within the picture element 27 are positive and polarities of the voltages to be applied to the pixels 13 and 14 are negative. Within the picture element 28, polarities of voltages to be applied to the pixels 17 and 18 are positive and polarities of the voltages to be applied to the pixels 15 and 16 are negative. As can be appreciated herefrom, among four pixels in the picture element, two pixels applied positive voltage and two pixels applied negative voltage are always present. Also, polarities of voltages applied to these pixels are inverted at every frame period of the liquid crystal display apparatus.

The foregoing discussion has been given extracting sixteen pixels forming a part of the liquid crystal display apparatus, it should be clear that number of pixels in the present invention should not be restricted to any specific number. Similarly, the number of data and gate bus lines are equally not limited. On the other hand, concerning display color of the pixels, discussion has been given for the case where one picture element consists of one red pixel, one blue pixel and two green pixels. The combination of the pixels consisting the picture element is not limited to any specific color combination.

Figure 3:
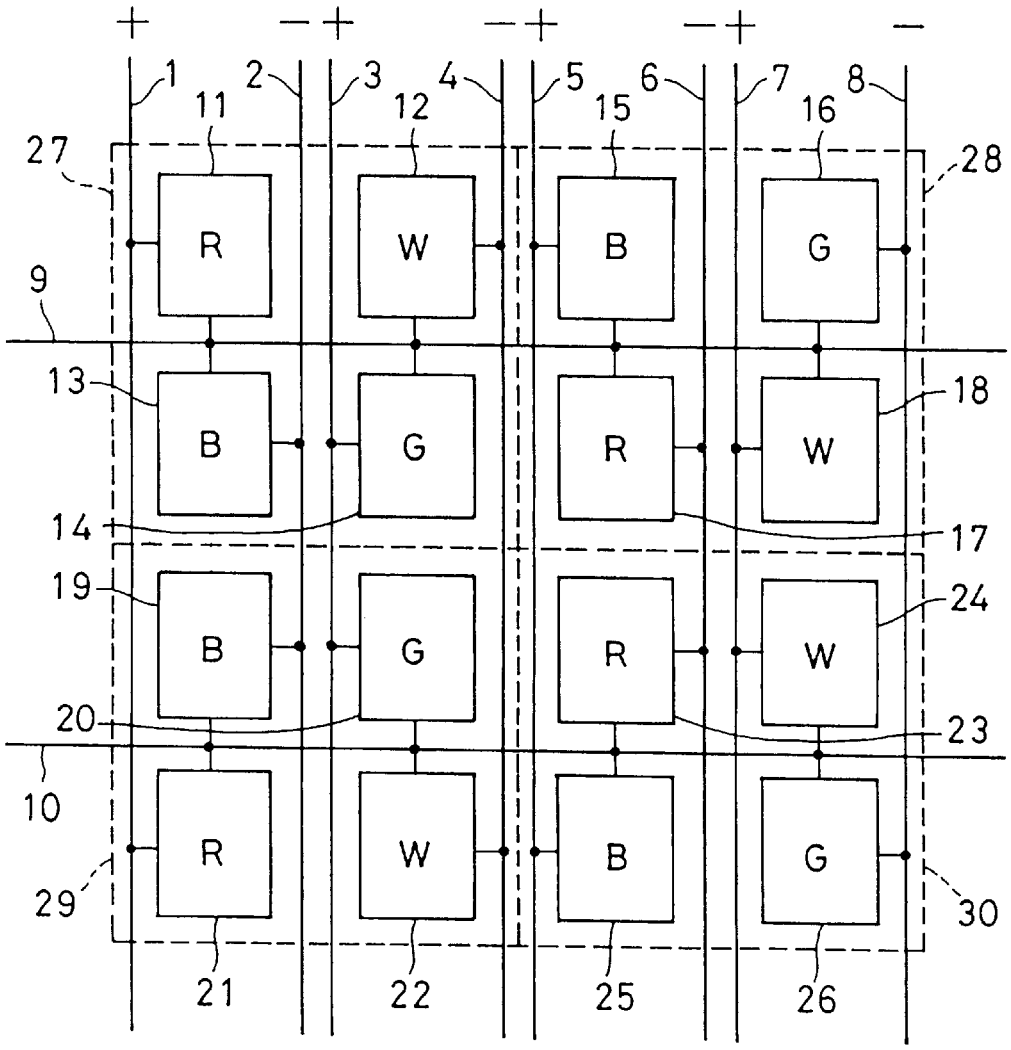
FIG. 3 is a schematic block diagram showing a pixel structure of the second embodiment of an active matrix type liquid crystal display apparatus according to the present invention.
Figure 4:
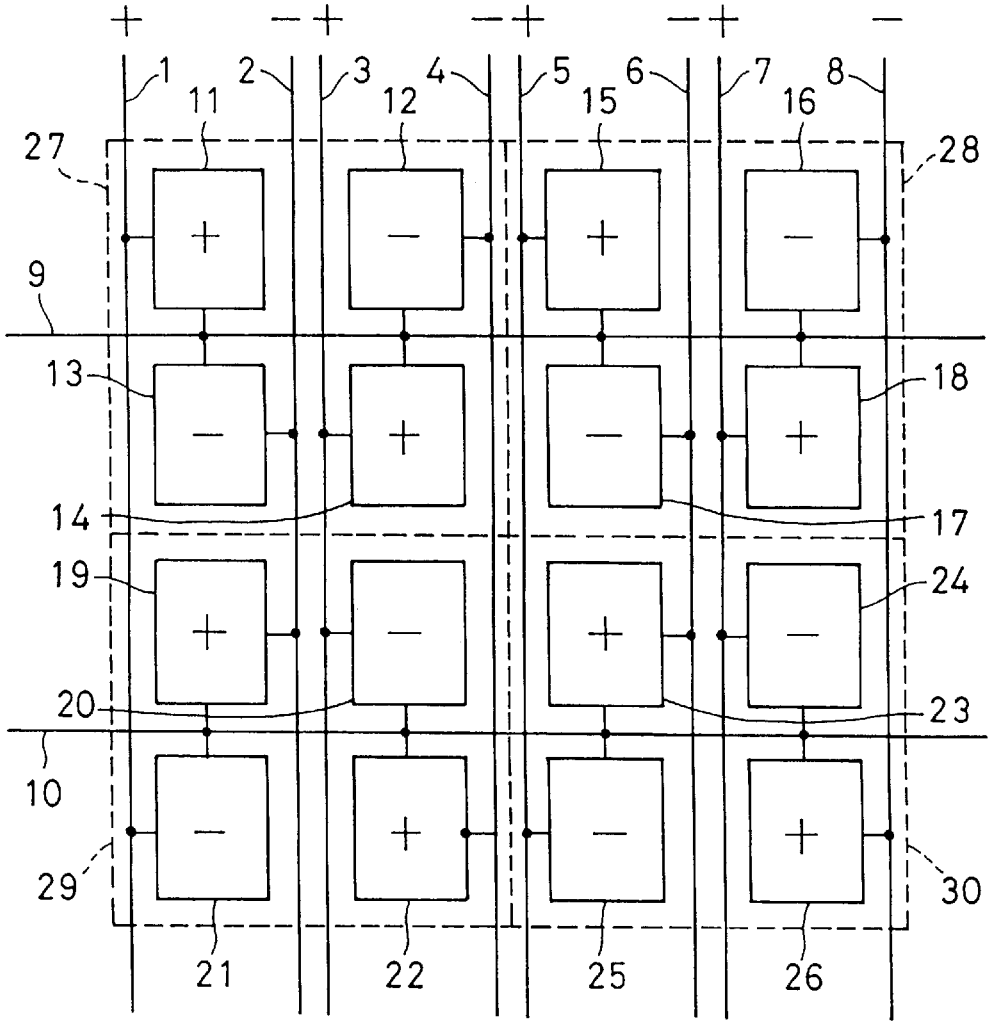
FIG. 4 is a schematic illustration showing polarities of voltages applied to respective pixels in the second embodiment of the active matrix type liquid crystal display apparatus according to the present invention.

Next, detailed discussion will be given for the second embodiment of the active matrix type liquid crystal display apparatus according to the present invention. FIG. 3 shows arrangement of the pixels in an arbitrary portion of a display region for discussing the second embodiment of the present invention. FIG. 4 is an illustration showing polarities of the holding voltages to be applied to the pixels during an arbitrary frame period with respect to the voltage of counter electrode.

In FIG. 3, the reference numerals 1 to 8 denote data bus lines, 9 and 10 denote gate bus lines, and 11 to 26 are pixels. One picture element is formed with a portion surrounded by broken lines 27 to 30 and consists of four pixels. Signs R, G, B and W labeled within respective blocks of the pixels 11 to 26 represent red display, green display, blue display and white display of respective pixels. In FIG. 3, the scanning circuit 100 and the driver circuit 200 are omitted, and it should be noted that the subsequent drawings are described by a similar manner.

In FIG. 3, positive sign (+) and negative sign (−) shown on data bus lines represent polarity of voltage to be applied to data bus lines 1 to 8 when the gate bus line 9 is selected at certain frame with respect to a voltage of the counter electrode. Each pixel is connected to one data bus line and one gate bus line. For example, the pixel 11 is connected to the data bus line 1 and the gate bus line 9.

When the gate bus line 9 is selected, voltages applied to the data bus lines 1 to 8 are written in the pixels 11 to 18. FIG. 4 is an illustration showing polarities of the holding voltage to be applied to the pixels during a certain frame period for explaining the second embodiment of the active matrix type liquid crystal display apparatus. In FIG. 4, the blocks labeled with "+" are blocks applied the pixel voltage which is positive relative to the voltage of the counter electrode, and the blocks labeled with "−" are blocks applied the pixel voltage which is negative relative to the voltage of the counter electrode.

In FIG. 4, consideration is given for the case where red is displayed over the entire area of the display portion, for example. Focusing pixels for displaying red in each picture element, polarities of the voltages applied to the pixels 11 and 23 are positive and the polarities applied to the pixels 17 and 21 are negative. Such polarity pattern of the voltages can be extended over the entire area of the display portion. When the polarity of the particular red pixel is positive, polarities of the voltages applied to red pixels next to the particular red pixels in upper side, lower side, left side and right side become negative. Namely, the red pixels applied the voltages of positive polarity are arranged in checkered pattern Likewise, the red pixels applied the voltage of negative polarity are arranged in checkered pattern.

Considering one picture element, polarities of voltages to be applied to the pixels 11 and 14 within the picture element 27 are positive and polarities of the voltages to be applied to the pixels 12 and 13 are negative. Within the picture element 28, polarities of voltages to be applied to the pixels 15 and 18 are positive and polarities of the voltages to be applied to the pixels 16 and 17 are negative. As can be appreciated herefrom, among four pixels in the picture element, two-pixels applied positive voltage and two pixels applied negative voltage are always present. Also, polarities of voltages applied to these pixels are inverted at every frame period of the liquid crystal display apparatus.

The foregoing discussion has been given extracting sixteen pixels forming a part of the liquid crystal display apparatus, it should be clear that number of pixels in the present invention should not be restricted to any specific number. Similarly, number of data and gate bus lines are equally not limited. On the other hand, concerning display color of the pixels, discussion has been given for the case where one picture element consists of one red pixel, one blue pixel and two green pixels. The combination of the pixels comprising the picture element is not limited to any specific color combination.

Figure 5:
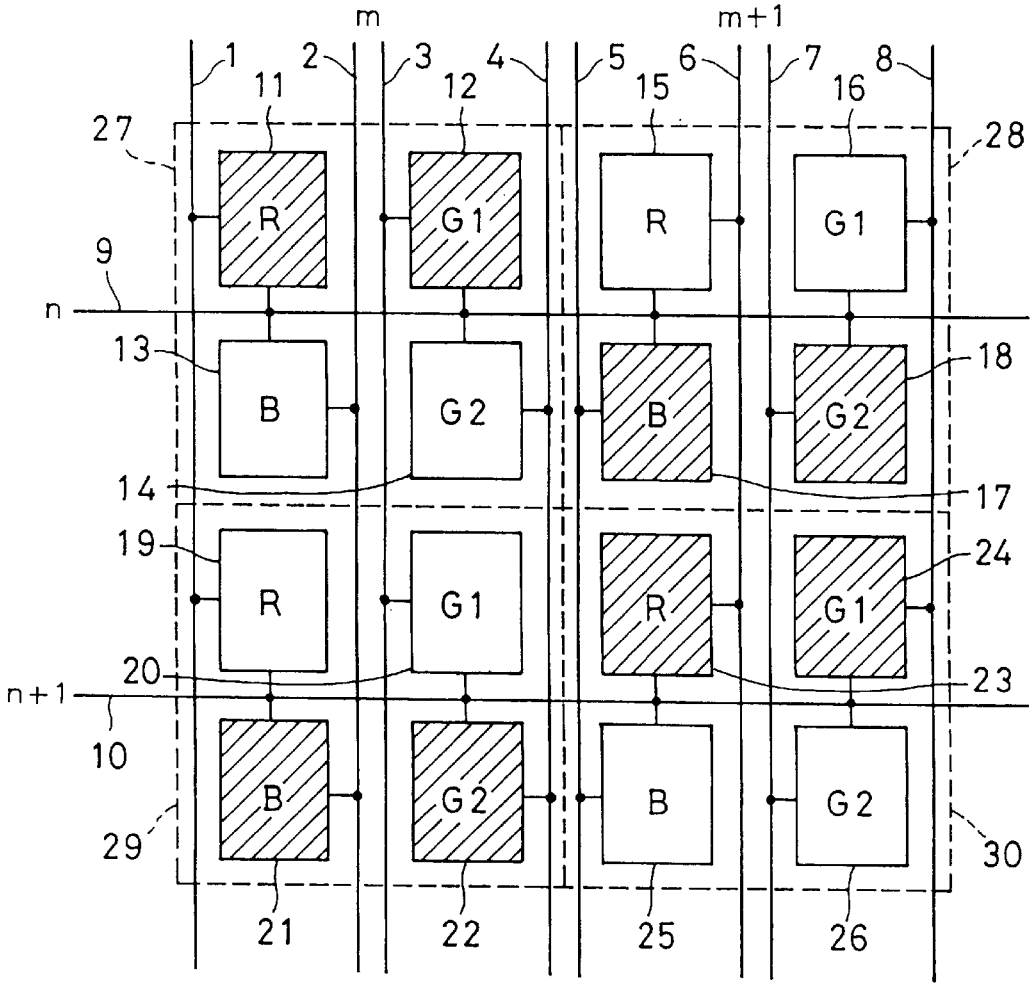
FIG. 5 is an illustration showing a pattern of respective polarities of voltages in the first embodiment of the active matrix type liquid crystal display apparatus according to the present invention.

Next, the first embodiment of the active matrix type liquid crystal display apparatus according to the present invention will be discussed hereinafter in greater detail with reference to the drawing. FIG. 5 is an illustration showing a connection of the pixels and each bus lines illustrating a portion of four picture elements arranged at (m)th and (m+1)th positions from left and at (n)th and (n+1)th positions from the top in the case where the present invention is applied to a normally white color TFT-LCD having 1600×1200 picture elements, in enlarged fashion. Here, m is a natural number from 1 to 1599, and n is a natural number from 1 to 1199.

Each picture element consists of four pixels. For performing color display, a color filter of red, blue and green is arranged in each individual pixel. Accordingly, the total number of data bus lines in FIG. 5 is 6400 and the number of gate bus lines is 1200. In FIG. 5, R represents the pixel displaying red, H represents the pixel displaying blue and G1 and G2 represent the pixels displaying green. Accordingly, in the shown embodiment, there is shown the case where two pixels out of four pixels display green.

Figure 6:
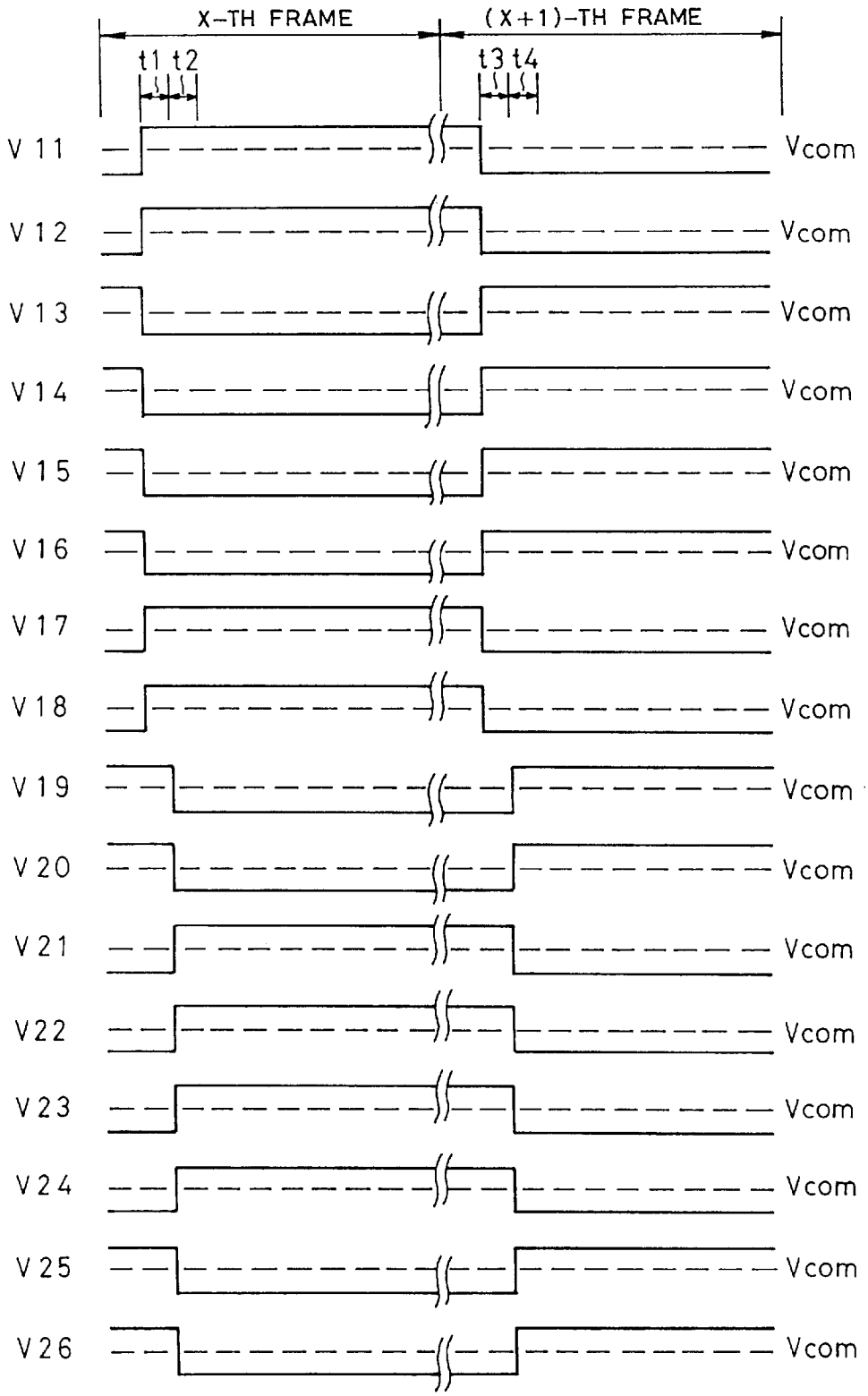
FIG. 6 is a timing chart of the first embodiment of the active matrix type liquid crystal display apparatus according to the present invention.

On the other hand, FIG. 6 shows a condition of voltages to be applied to the data bus lines 1 to 8 and the gate bus lines 9 and 10 in FIG. 5. In FIG. 6, V11 to V26 denote voltage values to be applied to the pixels 11 to 26 in FIG. 5, respectively, and $V_{com}$ denotes a voltage of the counter electrode.

In FIG. 5, pixels 11 to 18 are connected to the gate bus line 9 and pixels 19 to 26 are connected to the gate bus line 10. When each of the gate bus lines is selected, the voltage of the data bus line connected to respective pixel is written in the pixel. A period t1 of FIG. 6 is a period, in which the gate bus line 9 is selected in an arbitrary (x)th frame (x is natural number), t2 is a period, in which the gate bus line 10 is selected for the (x)th frame. When a period where each gate bus line is selected is terminated, each pixel holds the written voltage for one frame period.

Next, writing for (x+1)th frame is performed again for performing writing by selecting the gate bus line 9 during a period t3 and the gate bus line 10 during a period t4. In the (x)th frame and the (x+1)th frame, the polarities of the voltages to be applied to the pixels are inverted. Therefore, in case of FIG. 6, the pixels where the polarities of the voltages held in the pixels of the (x)th frame becomes positive with respect to the voltage $V_{com}$ of the counter electrode, are the pixels shown with hatching in FIG. 5, and the other pixels are supplied with the voltage of the negative polarity. On the other hand, in the (x+1)th frame, for the pixels shown with hatching in FIG. 5, the voltage of the negative polarity with respect to the voltage $V_{com}$ of the counter electrode is applied.

Figure 7:
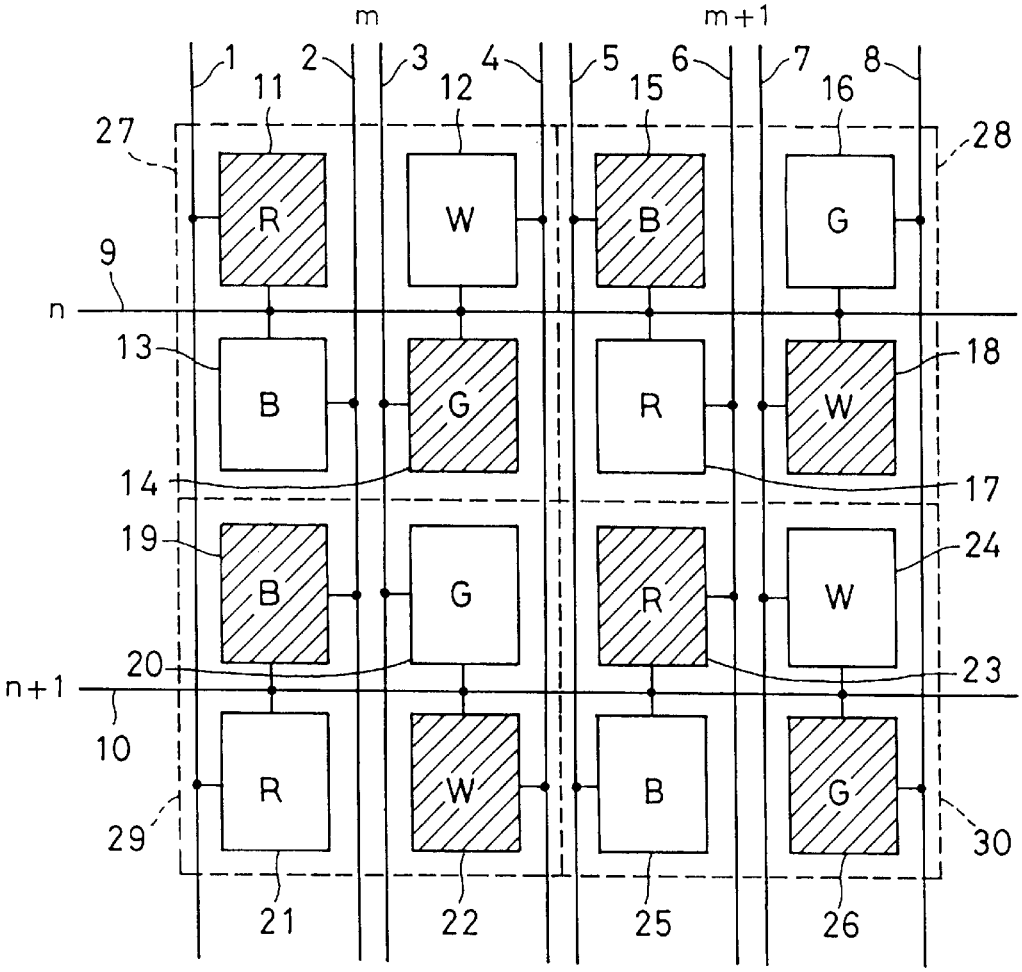
FIG. 7 is an illustration showing a pattern of respective polarities of voltages in the second embodiment of the active matrix type liquid crystal display apparatus according to the present invention.

Next, the second embodiment of the active matrix type liquid crystal display apparatus according to the present invention will be discussed hereinafter in greater detail with reference to the drawing. FIG. 7 is an illustration showing a connection of the pixels and each bus lines illustrating a portion of four picture elements arranged at (m)th and (m+1)th positions from left and at (n)th and (n+1)th positions from the top in the case where the present invention is applied to a normally white color TFT-LCD having 1600×1200 picture elements, in enlarged fashion. Here, m is natural number from 1 to 1599, and n is natural number from 1 to 1199.

Each picture element consists of four pixels. For performing color display, a color filter of red, blue, green and white is arranged in each individual pixel. Accordingly, the total number of data bus lines in FIG. 7 is 6400 and the number of gate bus lines is 1200.

Figure 8:
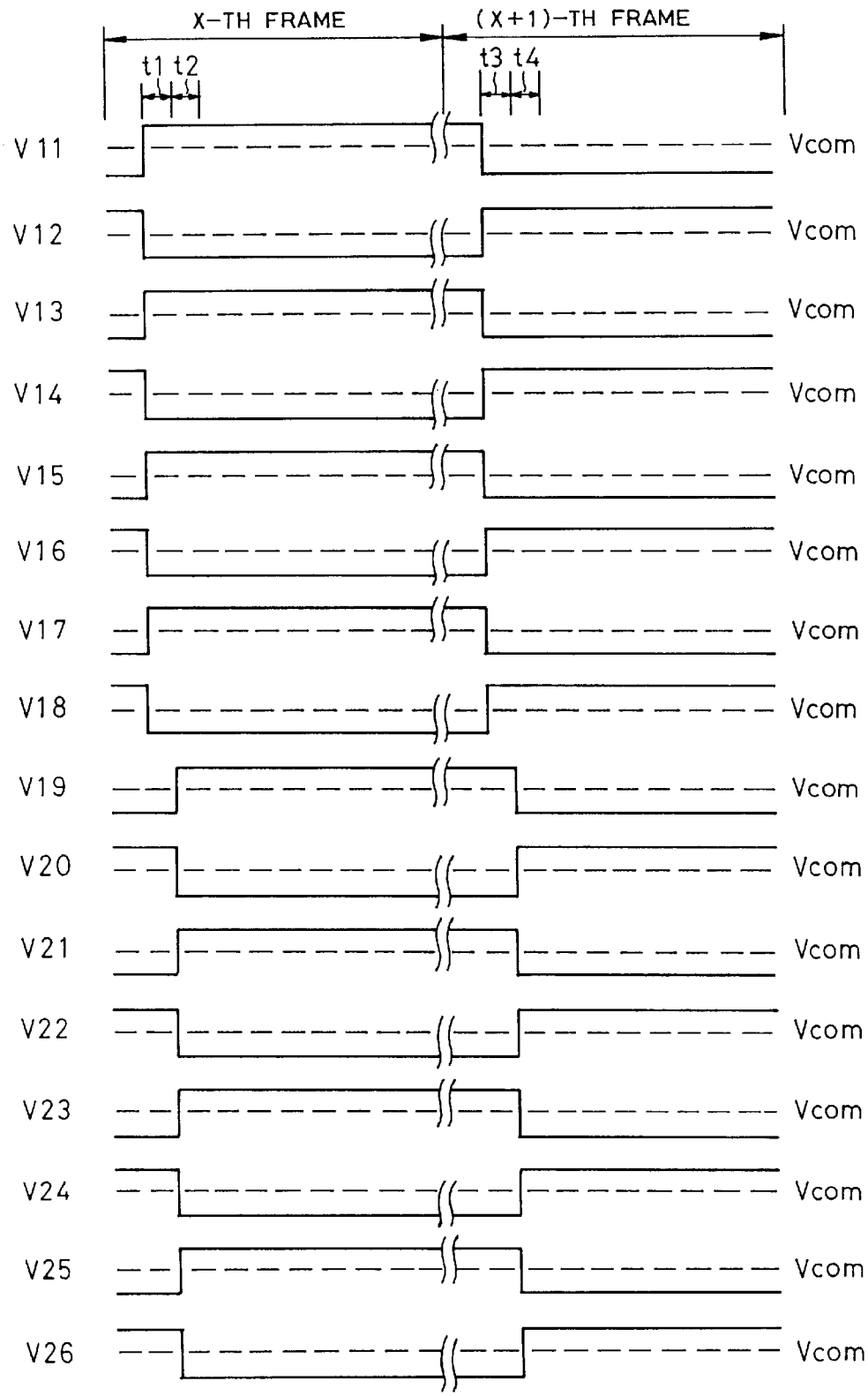
FIG. 8 is a timing chart of the second embodiment of the active matrix type liquid crystal display apparatus according to the present invention.

In FIG. 7, R represents the pixel displaying red, B represents the pixel displaying blue, G represents the pixels displaying green and W represents the pixel of white. On the other hand, FIG. 8 is an illustration showing a condition of voltages to be applied to the date bus lines 1 to 8 and the gate bus lines 9 and 10. In FIG. 8, V11 to V26 are voltage values applied to the pixels 11 to 26 of FIG. 7, and $V_{com}$ is the voltage of the counter electrode.

In FIG. 7, pixels 11 to 18 are connected to the gate bus line 9 and pixels 19 to 26 are connected to the gate bus line 10. When each of the gate bus lines is selected, the voltage of the data bus line connected to each respective pixel is written in the pixel. A period t1 of FIG. 8 is a period, in which the gate bus line 9 of FIG. 7 is selected in an arbitrary (x)th frame (x is a natural number), t2 is a period, in which the gate bus line 10 is selected for the (x)th frame. When a period where each gate bus line is selected is terminated, each pixel holds the written voltage for one frame period.

Next, writing for (x+1)th frame is performed again for performing writing by selecting the gate bus line 9 during a period t3 and the gate bus line 10 during a period t4. In the (x)th frame and the (x+1)th frame, the polarities of the voltages to be applied to the pixels are inverted. Therefore, in case of FIG. 8, the pixels where the polarities of the voltages held in the pixels of the (x)th frame becomes positive with respect to the voltage $V_{com}$ of the counter electrode, are the pixels shown with hatching in FIG. 7, and the other pixels are supplied with the voltage of the negative polarity. On the other hand, in the (x+1)th frame, for the pixels shown with hatching in FIG. 7, the voltage of the negative polarity with respect to the voltage $V_{com}$ of the counter electrode is applied.

Figure 9:
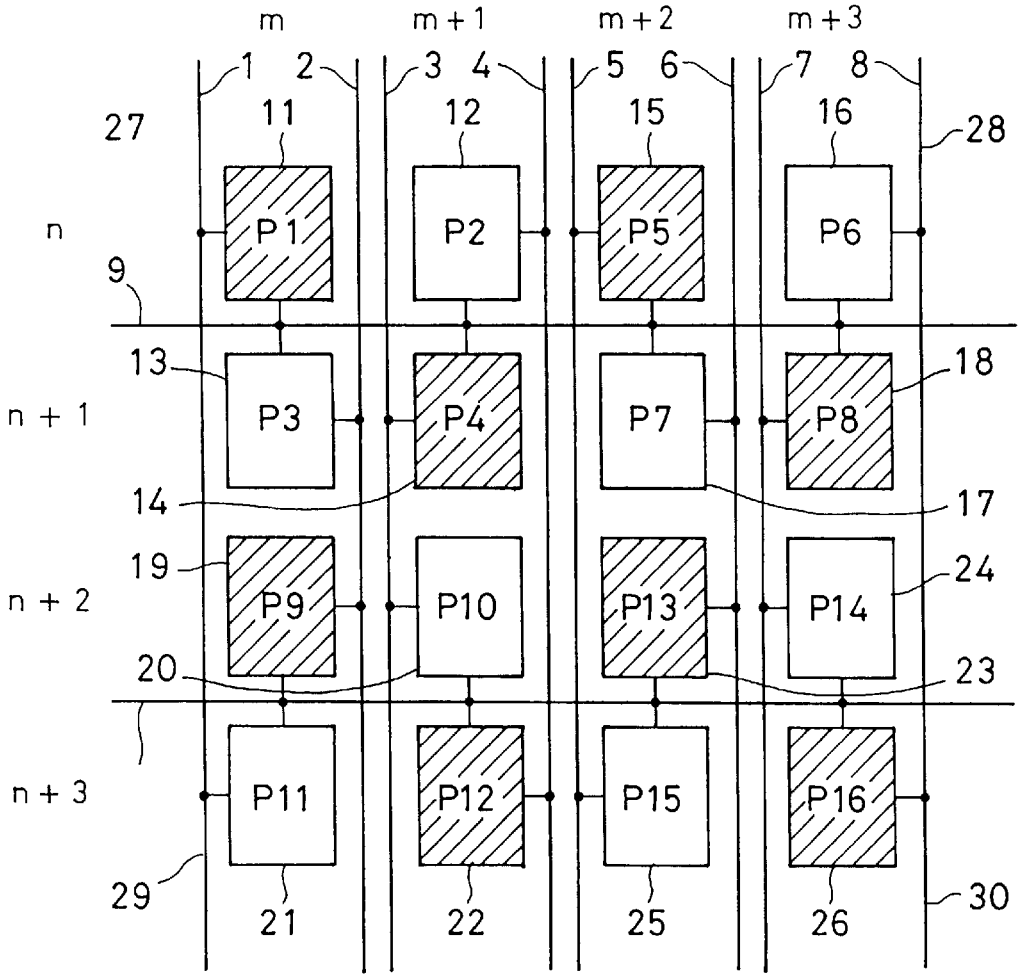
FIG. 9 is a schematic block diagram showing a pixel structure of the third embodiment of an active matrix type liquid crystal display apparatus according to the present invention.

Next, the third embodiment of the active matrix type liquid crystal display apparatus according to the present invention will be discussed hereinafter in greater detail with reference to the drawing. FIG. 9 is an illustration showing a connection of the pixels and each bus lines illustrating a portion of sixteen picture elements arranged at (m) th to (m+3) th positions from left and at (n) th to (n+3) th positions from the top in the case where the present invention is applied to a normally white color TFT-LCD having 3200×2400 picture elements, in enlarged fashion. Here, m is a natural number from 1 to 3197, and n is a natural number from 1 to 2397.

Figure 10:
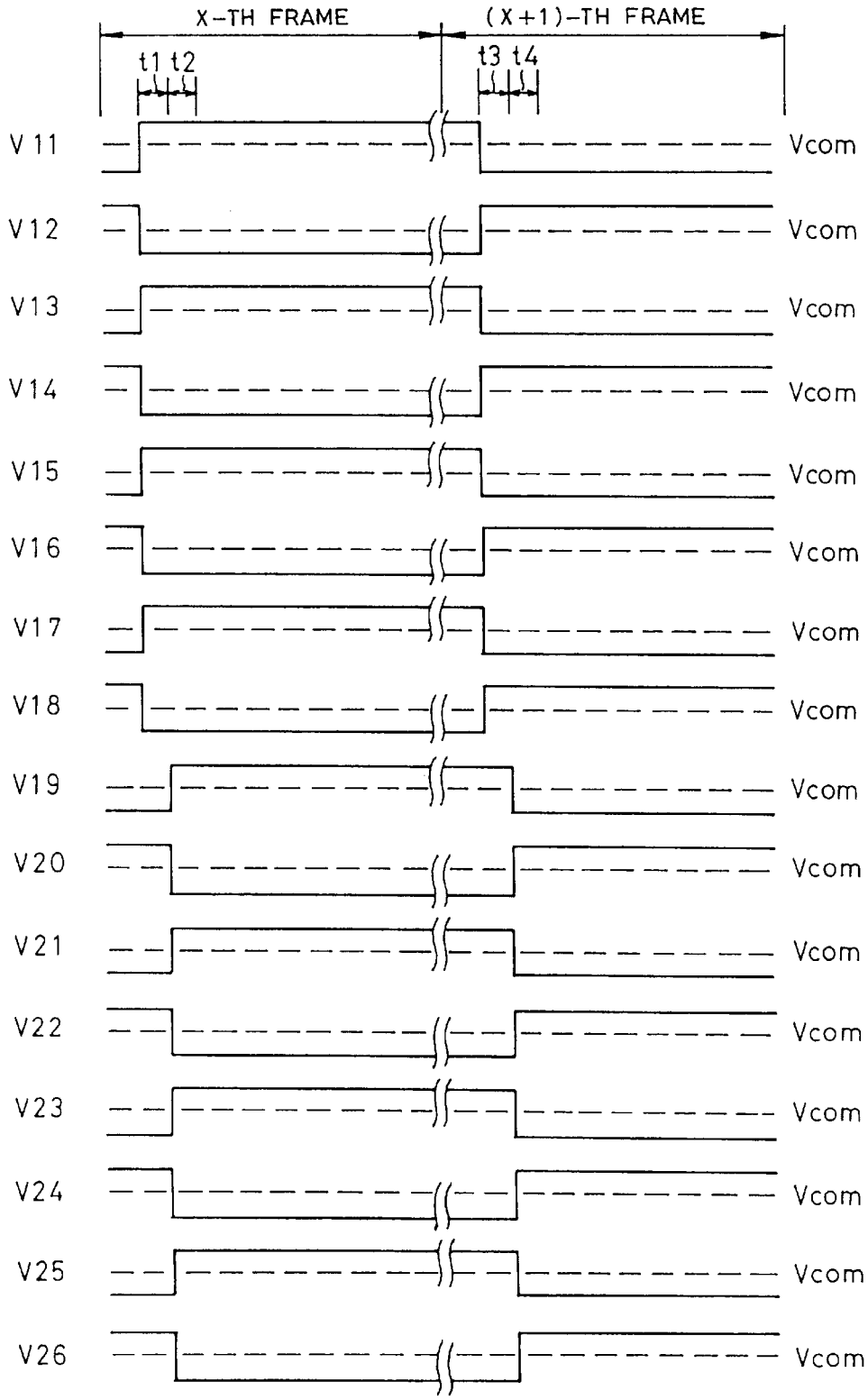
FIG. 10 is a timing chart of the third embodiment of the active matrix type liquid crystal display apparatus according to the present invention.
Figure 11:
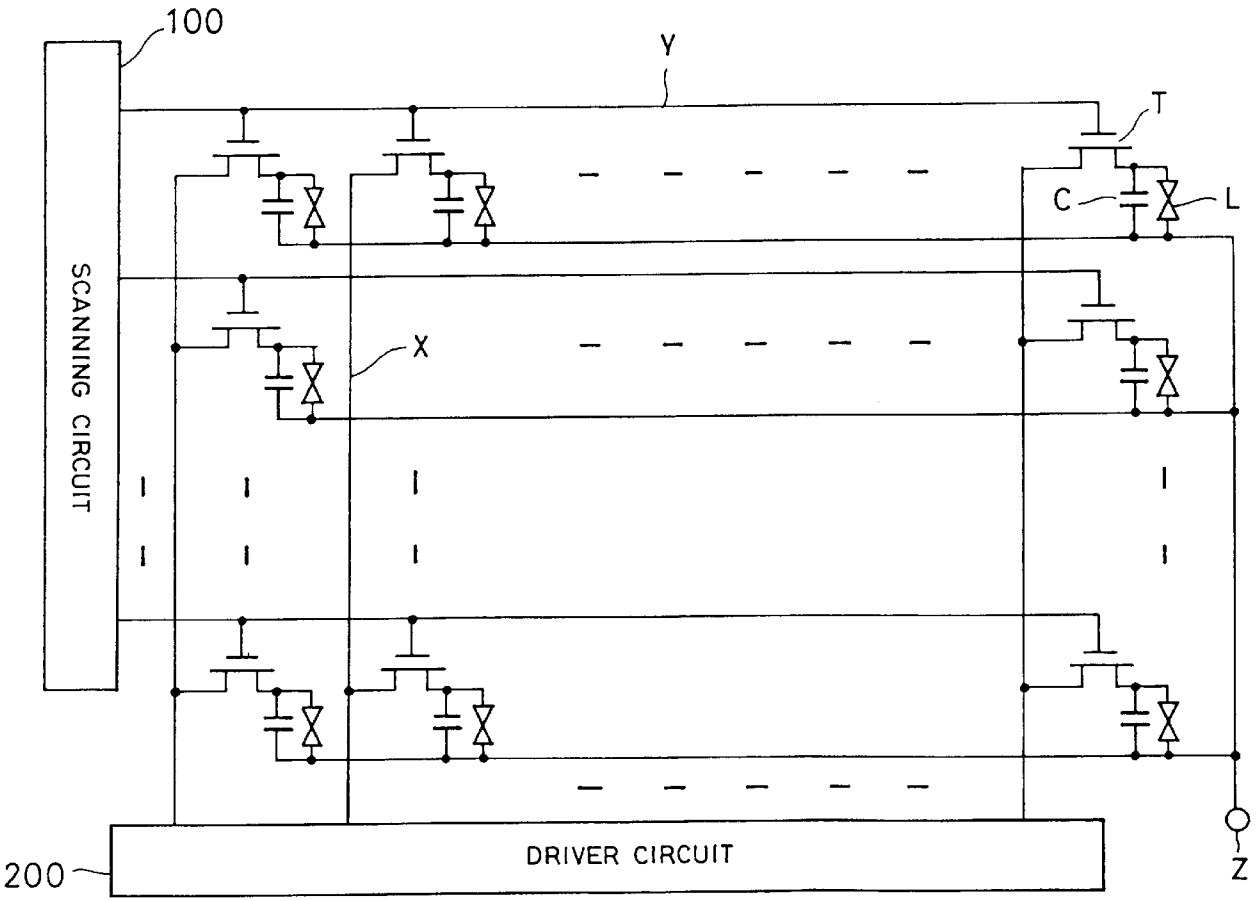
FIG. 11 is a schematic block diagram showing an overall construction of a liquid crystal display apparatus.
Figure 13:
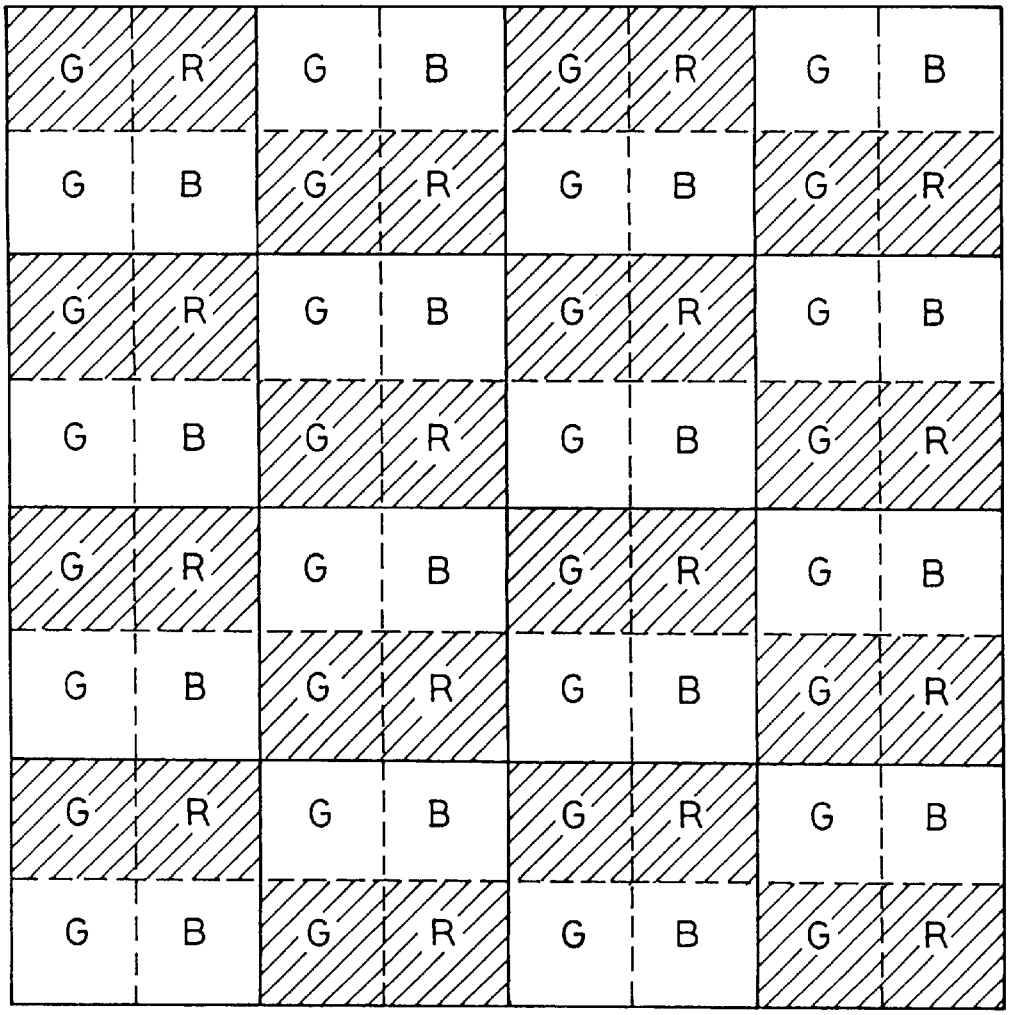
FIG.13 (PRIOR ART)
FIG. 13 is a schematic illustration showing one pattern of polarities of voltages to be applied to respective pixels in the conventional liquid crystal display apparatus.
Figure 14:
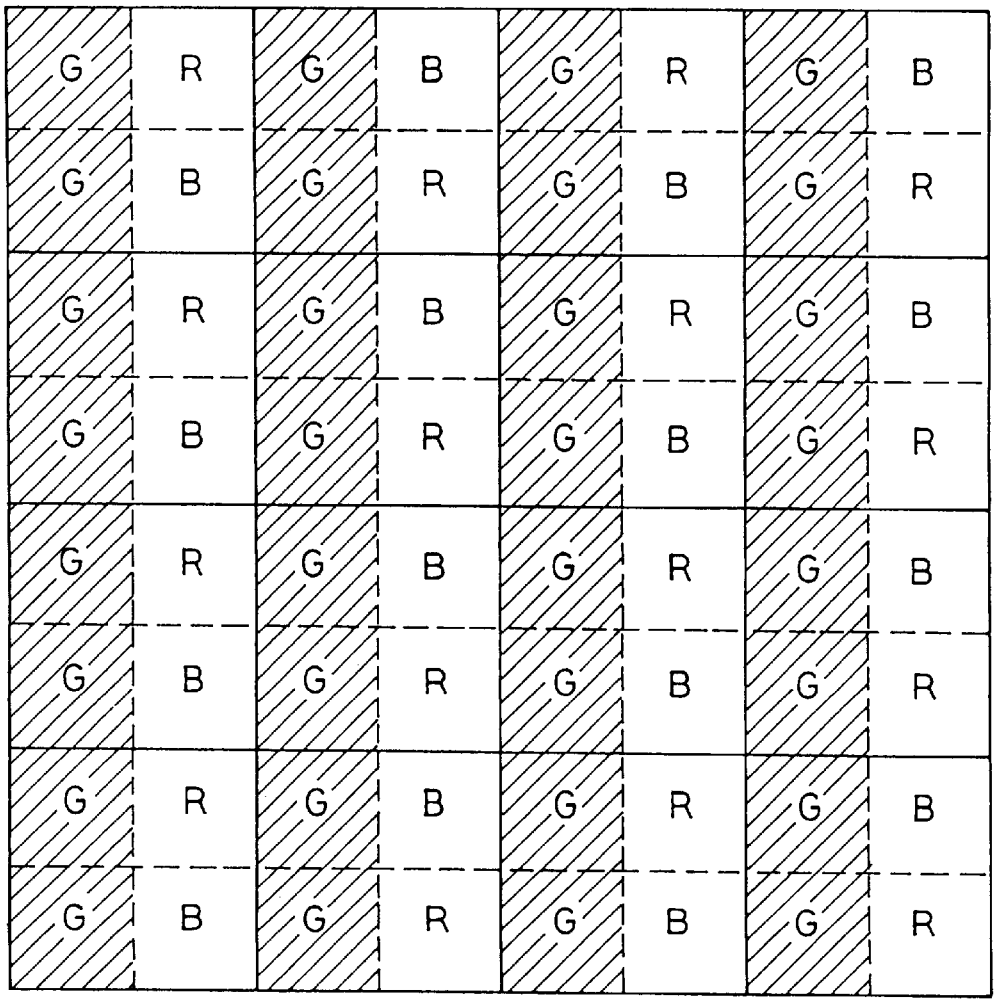
FIG.14 (PRIOR ART)
FIG. 14 is a schematic illustration showing another pattern of polarities of voltages to be applied to respective pixels in the conventional liquid crystal display apparatus.
Figure 15:
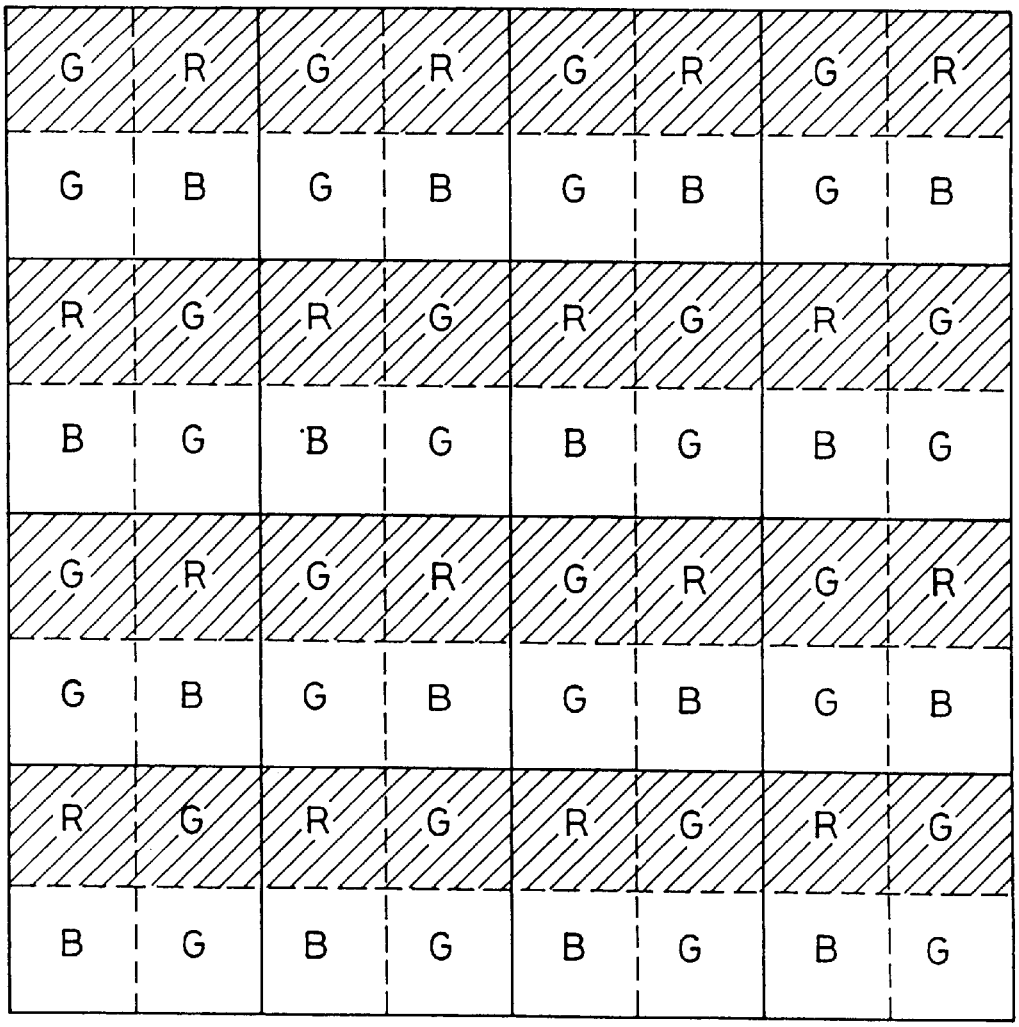
FIG.15 (PRIOR ART)
FIG. 15 is a schematic illustration showing a further pattern of polarities of voltages to be applied to respective pixels in the conventional liquid crystal display apparatus.
Figure 16:
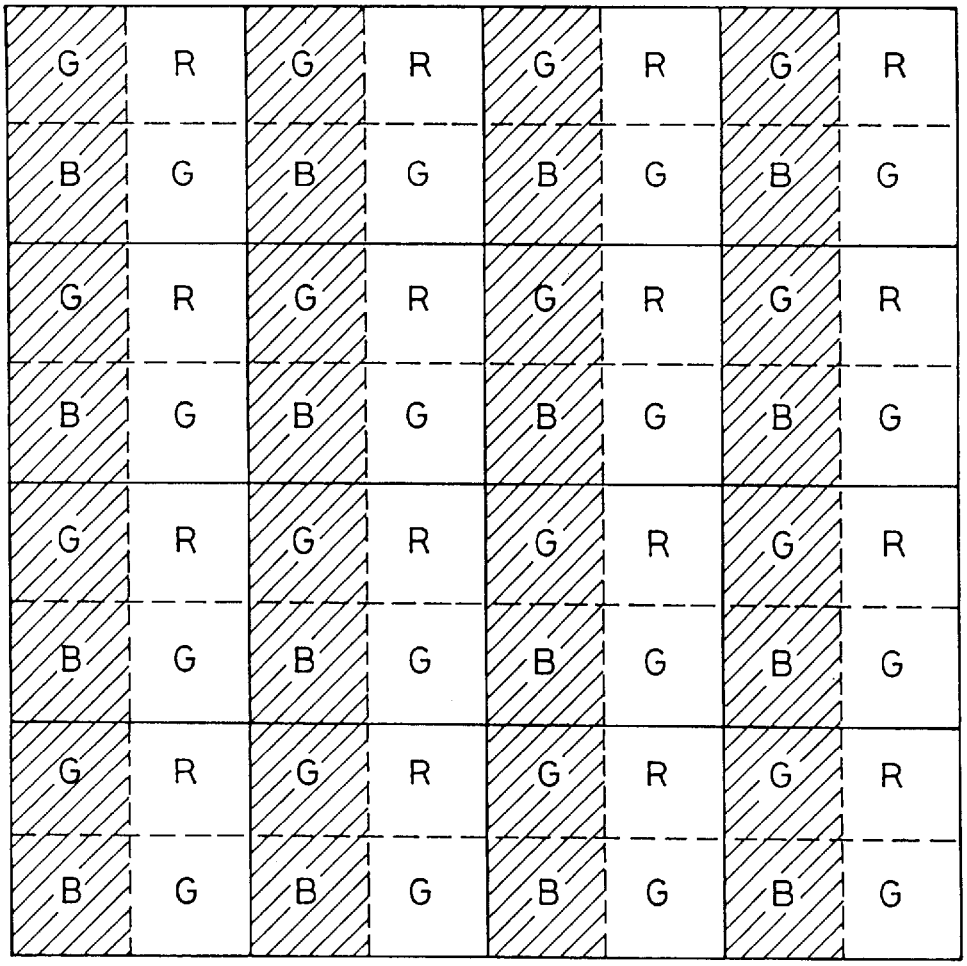
FIG.16 (PRIOR ART)
FIG. 16 is a schematic illustration showing a still further pattern of polarities of voltages to be applied to respective pixels in the conventional liquid crystal display apparatus.

In FIG. 9, total number of the data bus lines is 6400, and number of gate bus lines is 1200. In FIG. 9, P1 to P16 represent liquid crystal pixels which reduce transmission coefficients in proportional to the applied voltage. On the other hand, FIG. 10 shows a condition of the voltage to be applied to the data bus lines 1 to 8 and gate bus lines 9 and 10 in FIG. 9. In FIG. 10, V11 to V26 are voltage value to be applied pixels 11 to 26 of FIG. 9. and $V_{com}$ is a voltage of the counter electrode.

In FIG. 9, pixels 11 to 18 are connected to the gate bus line 9 and pixels 19 to 26 are connected to the gate bus line 10. When each of the gate bus lines is selected, the voltage of the data bus line connected to respective pixel is written in the pixel. In the shown liquid crystal display apparatus, since 3200×2=6400 pixels are connected to one gate bus line, when one gate bus lines is selected, the video data for two columns in lateral direction are written.

A period t1 of FIG. 10 is a period, in which the gate bus line 9 of FIG. 9 is selected in an arbitrary (x)th frame (x is natural number) and voltage is applied to the pixels arranged in the (n)th and (n+1)th columns from the top, t2 is a period, in which the gate bus line 10 is selected for the (x)th frame and voltage is applied to the pixels arranged in the (n+2)th and (n+3)th columns. When a period where each gate bus line is selected is terminated, each pixel holds the written voltage for one frame period. Next, writing for (x+1)th frame is performed again for performing writing by selecting the gate bus line 9 during a period t3 and the gate bus line 10 during a period t4.

In the (x)th frame and the (x+1)th frame, the polarities of the voltages to be applied to the pixels are inverted. In case of FIG. 10, the pixels where the polarities of the voltages held in the pixels of the (x)th frame becomes positive with respect to the voltage $V_{com}$ of the counter electrode, are the pixels shown with hatching in FIG. 9, and the other pixels are supplied with the voltage of the negative polarity. On the other hand, in the (x+1)th frame, for the pixels shown with hatching in FIG. 9, the voltage of the negative polarity with respect to the voltage $V_{com}$ of the counter electrode is applied.

As set forth above, the active matrix type liquid crystal display apparatus according to the present invention can reduce flicker which can be a cause of degradation of the picture quality. One reason is that while one picture element consists of four pixels, the polarities of the voltage to be applied to the pixels at the same positions of adjacent picture elements are inverted with respect to the voltage of the counter electrode. Therefore, even for simple color of red, green or blue, a difference of luminance generated by the polarity of the voltage applied to the liquid crystal can be canceled. Also, since the polarities of the voltages to be applied to the pixels in one picture element are inverted per two pixels, the luminance difference to be caused due to polarity of the voltage to be applied to the liquid crystal can be canceled even in gray display.

Although the present invention has been illustrated and described with respect to exemplary embodiments thereof, it should be understood by those skilled in the art that the foregoing and various changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. An active matrix type liquid crystal display apparatus comprising:

display picture elements, each consisting of four pixels of first to four pixels arranged vertically and horizontally per two;

scanning lines, each being in common for said four pixels;

data lines arranged per two on opposite sides of vertically aligned two pixels;

a common electrode being common for said four pixels;

a data driver circuit for writing voltages from said data lines simultaneously for said four pixels of each picture element when said one scanning line is selected, said pixels located at the same position in laterally adjacent picture elements being connected to data lines at different sides relative to each other; and said data driver circuit being controlled to apply opposite polarities of voltages to adjacent data lines with respect to a voltage for said common electrode, and to invert polarities of the voltages to be applied to respective data lines with respect to the voltage of said common electrode when said scanning line is selected.

2. An active matrix type liquid crystal display apparatus as set forth in claim 1, wherein said data driver circuit performs control for inverting polarity with respect to said common electrode per frame.

3. An active matrix type liquid crystal display apparatus as set forth in claim 2, wherein said first, second, third and fourth pixels display red, green, green and blue.

4. An active matrix type liquid crystal display apparatus as set forth in claim 2, wherein said first, second, third and fourth pixels display red, green, white and blue.

5. An active matrix type liquid crystal display apparatus as set forth in claim 2, wherein said first, second, third and fourth pixels display white, respectively.

6. An active matrix type liquid crystal display apparatus comprising:

a plurality of mutually parallel data lines;

a plurality of mutually parallel scanning lines arranged perpendicular to said data lines;

field effect type transistors, each provided in the vicinity of each intersection of said data line and said scanning line;

pixel electrodes, each connected to said field effect type transistor;

a common electrode;

liquid crystal provided between said pixel electrodes and said common electrode, each four pixels forming one picture element;

a scanning circuit sequentially applying voltages to said scanning lines;

a data driver circuit receiving a display data and applying voltages corresponding said display data for said data lines;

said display driver circuit controlling application of voltage so that polarities of the voltages to be applied to first, second, third and fourth pixels of a first picture element at an arbitrary position of a display portion relative to a voltage of said common electrode are the same polarity in said first and second pixels, the same polarity in said third and fourth pixels and opposite polarity in said first and third pixels;

so that polarities of voltages to be applied to said first to fourth pixels of said first picture element relative to the voltage of said common electrode being inverted at a period of a frame frequency;

so that polarities of voltages to be applied to fifth, sixth, seventh and eighth pixels located at the corresponding position to said first pixel in second, third, fourth and fifth picture elements adjacent to said first picture element in vertical and lateral directions are opposite to the polarity of the voltage to be applied to said first pixel;

so that the polarities of voltages to be applied to ninth, tenth, eleventh and twelfth pixels located at the corresponding position to said first pixel in sixth, seventh, eighth and ninth picture elements obliquely adjacent to said first picture element respectively located at obliquely upper left side, obliquely upper right side, obliquely lower left side and obliquely lower right side are the same as the polarity of the voltage to be applied to said first pixel.

7. An active matrix type liquid crystal display apparatus as set forth in claim 6, wherein said first, second, third and fourth pixels display red, green, green and blue.

8. An active matrix type liquid crystal display apparatus as set forth in claim 6, wherein said first, second, third and fourth pixels display red, green, white and blue.

9. An active matrix type liquid crystal display apparatus as set forth in claim 6, wherein said first, second, third and fourth pixels display white, respectively.

* * * * *